US009409580B2

(12) United States Patent
Fan et al.

(10) Patent No.: US 9,409,580 B2
(45) Date of Patent: Aug. 9, 2016

(54) OBSTACLE REMOVING AND ENERGY ABSORBING DEVICE AND LEADING CAR OF MOTOR TRAIN UNIT

(71) Applicant: TANGSHAN RAILWAY VEHICLE CO., LTD., Tangshan (CN)

(72) Inventors: Letian Fan, Tangshan (CN); Guoping Zhang, Tangshan (CN); Jiangong Wang, Tangshan (CN); Jijun Ma, Tangshan (CN); Quanmei Guan, Tangshan (CN); Qinggang Zhang, Tangshan (CN); Peng Li, Tangshan (CN)

(73) Assignee: TANGSHAN RAILWAY VEHICLE CO., LTD., Hebei (CN)

( * ) Notice: Subject to any disclaimer, the term of this patent is extended or adjusted under 35 U.S.C. 154(b) by 88 days.

(21) Appl. No.: 14/306,102

(22) Filed: Jun. 16, 2014

(65) Prior Publication Data

US 2014/0290528 A1 Oct. 2, 2014

Related U.S. Application Data

(63) Continuation of application No. PCT/CN2012/083296, filed on Oct. 22, 2012.

(30) Foreign Application Priority Data

Dec. 16, 2011 (CN) ..... 2011 1 0424043

(51) Int. Cl.
*B61D 15/06* (2006.01)
*B61F 19/04* (2006.01)
*B61D 17/06* (2006.01)

(52) U.S. Cl.
CPC ..... *B61D 15/06* (2013.01); *B61D 17/06* (2013.01); *B61F 19/04* (2013.01)

(58) Field of Classification Search
CPC ..... B61G 11/00; B61G 11/08; B61G 11/10; B61G 11/12; B61G 11/14; B61G 11/16; B61G 11/18
USPC ..... 105/392.5, 396, 402, 413, 419; 213/7–9, 40 R, 44, 50, 220, 221
See application file for complete search history.

(56) References Cited

U.S. PATENT DOCUMENTS 6,167,815 B1 * 1/2001 Werner ..... B61F 19/04 105/392.5

FOREIGN PATENT DOCUMENTS

CN 201236326 Y 5/2009
CN 201357839 Y 12/2009

(Continued)

OTHER PUBLICATIONS

The extended European Search Report of corresponding European patent application No. 12857013 and corresponding international PCT application No. PCT/CN2012/083296, dated Dec. 3, 2014.

(Continued)

*Primary Examiner* — R. J. McCarry, Jr.
(74) *Attorney, Agent, or Firm* — J.C. Patents

(57) ABSTRACT

An obstacle removing and energy absorbing device provided with an obstacle removing beam (6) and a bumper cross-beam (15) which are oppositely arranged, an energy-absorbing tube assembly with an energy-absorbing tube (9) is fixedly connected between the obstacle removing beam (6) and the bumper cross-beam (15), a mounting base (8) is fixedly connected with one end of the energy-absorbing tube (9), a crushing support (13) is threaded onto the other end of the energy-absorbing tube (9), the crushing support (13) is provided with a variable-diameter through-hole, a crushing-convex portion (20) is provided in the variable-diameter through-hole, a concave portion (21) matched with the crushing-convex portion (20) is arranged at an end portion where the energy-absorbing tube (9) is penetrated into the crushing support (13), the mounting base (8) is fixedly connected with the obstacle removing beam (6), the crushing support (13) is fixedly connected with the bumper cross-beam (15).

20 Claims, 4 Drawing Sheets

(56) References Cited

FOREIGN PATENT DOCUMENTS

| | | | |
|---|---|---|---|
| CN | 101801757 | A | 8/2010 |
| CN | 102514588 | A | 6/2012 |
| DE | 10 2004 025 095 | A1 | 12/2005 |
| DE | 102004025095 | A1 | 12/2005 |
| EP | 1 247 716 | A1 | 10/2002 |
| JP | 2007-161128 | A | 6/2007 |
| KR | 10-1063942 | B1 | 9/2011 |
| WO | WO 2009/034123 | A1 | 3/2009 |

OTHER PUBLICATIONS

Chen, Ding et al., "Design and Simulation Research on the Energy Absorption Fender on the Head Car of a High Speed Train" Rolling Stock, Issue 1, No. 49, Jan. 2011, pp. 1-4, ISSN No. 1002-7602.

International Search Report of corresponding International PCT Application No. PCT/CN2012/083296, dated Jan. 31, 2013.

* cited by examiner

OBSTACLE REMOVING AND ENERGY ABSORBING DEVICE AND LEADING CAR OF MOTOR TRAIN UNIT

CROSS-REFERENCE TO RELATED APPLICATIONS

This application is a continuation of International Application No. PCT/CN2012/083296, filed on Oct. 22, 2012, which claims priority to Chinese Patent Application No. 201110424043.9, filed on Dec. 16, 2011, both of which are incorporated herein by reference in their entireties.

TECHNICAL FIELD

The present invention relates to rail train technology and, in particular, relates to an obstacle removing and energy absorbing device and a leading car of a motor train unit.

BACKGROUND

An obstacle removing device is a safety protecting device of a rail train for removing possible obstacles on rail tracks so as to avoid operation accidents such as derailment etc.

As shown in FIG. 1, an earlier obstacle removing device used on a locomotive is formed by welding a contour bending plate 1 with a reinforcing plate, a supporting beam 2 of the obstacle removing device is welded on both ends of the contour bending plate 1 respectively, an end, which is distal to the contour bending plate 1, of the supporting beam 2 of the obstacle removing device is provided with a mounting plate 3, the obstacle removing device is mounted on the lower portion of the towing beam of the locomotive via a bolt threaded onto the mounting plate 3, the obstacle removing device in such a structure does not have buffering and energy absorbing functions, when the obstacle removing device collides with an obstacle, the impact force will be directly transferred to the car body, which will significantly affect stability and safety of the moving train.

As the running speed of the train increases, in order to reduce the impact force suffered by the car body when the obstacle removing device collides with an obstacle, an obstacle removing device with a buffer structure is presented, as shown in FIG. 2. Buffer plate clusters 4 formed by stacking multiple aluminum plates spaced with cushion blocks are mounted behind the obstacle removing plate of the device, there is a certain gap between the obstacle removing plate 6 and the buffer plate clusters 4, when the collision force is small, the buffer plate clusters 4 is of no effect, when the collision force is large, after the obstacle removing plate 5 is deformed and is contacted with the buffer plate clusters 4, the aluminum plate in the buffer plate clusters 4 absorbs a part of impact energy through its elastic deformation. Such a structure guarantees obstacle removing ability, and meanwhile can moderate the impact to the car body to some extent, but its buffering property is limited, and still cannot guarantee stability and safety of the moving train.

SUMMARY

The present invention provides an obstacle removing and energy absorbing device and a leading car of a motor train unit, so as to solve the problem that the buffering property of the obstacle removing device in the prior art is limited and thus cannot guarantee stability and safety of the moving train.

One aspect of the present invention provides an obstacle removing device, including an obstacle removing beam and a bumper cross-beam which are oppositely arranged, an energy absorbing tube assembly with an energy absorbing tube is fixedly connected between the obstacle removing beam and the bumper cross-beam, a mounting base is fixedly connected with one end of the energy absorbing tube, while a crushing support is threaded onto the other end of the energy absorbing tube, the crushing support is provided with a variable-diameter through-hole, a crushing convex portion is provided in the variable-diameter through-hole, a concave portion matched with the crushing convex portion is arranged at an end portion where the energy absorbing tube is penetrated into the crushing support, the mounting base is fixedly connected with the obstacle removing beam, and the crushing support is fixedly connected with the bumper cross-beam.

Another aspect of the present invention further provides a leading car of a motor train unit including a car body, and any obstacle removing and energy absorbing device described above, the bumper cross-beam of the obstacle removing and energy absorbing device is fixedly connected with a front end of the car body, and the obstacle removing beam of the obstacle removing and energy absorbing device is arranged towards the moving direction of the leading car.

In the obstacle removing and energy absorbing device provided by embodiments of the present invention, since an energy absorbing tube assembly is provided, when the obstacle removing and energy absorbing device collides with an obstacle and produces large impact, the energy absorbing tube in the energy absorbing tube assembly is crushingly deformed to absorb most of the impact energy, such that the car body suffers less impact, which guarantees stability and safety of the moving train.

The leading car of motor train unit provided by the present invention, since the obstacle removing and energy absorbing device of above structure is adopted, when colliding with an obstacle and producing large impact, the obstacle removing and energy absorbing device absorbs most of the impact energy, such that the leading car of the motor train unit suffers less impact, which guarantees stability and safety of the moving train.

DESCRIPTION OF EMBODIMENTS

Figure 1:
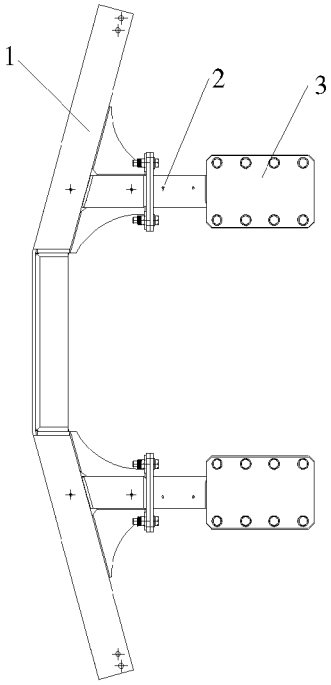
Fig. 1 (Prior Art)
FIG. 1 is a schematic structural diagram of an obstacle removing and energy absorbing device in the prior art.
Figure 2:
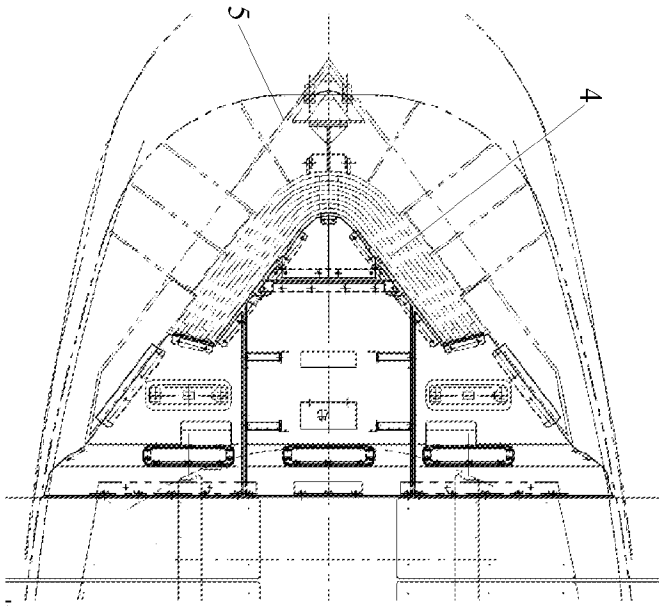
Fig. 2 (Prior Art)
FIG. 2 is a schematic structural diagram of another obstacle removing and energy absorbing device in the prior art.
Figure 3:
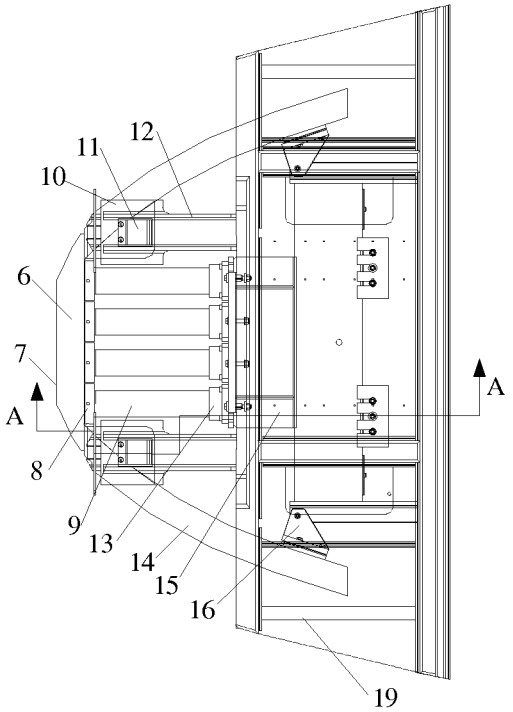
FIG. 3 is a schematic structural diagram of an obstacle removing and energy absorbing device according to an embodiment of the present invention.
Figure 4:
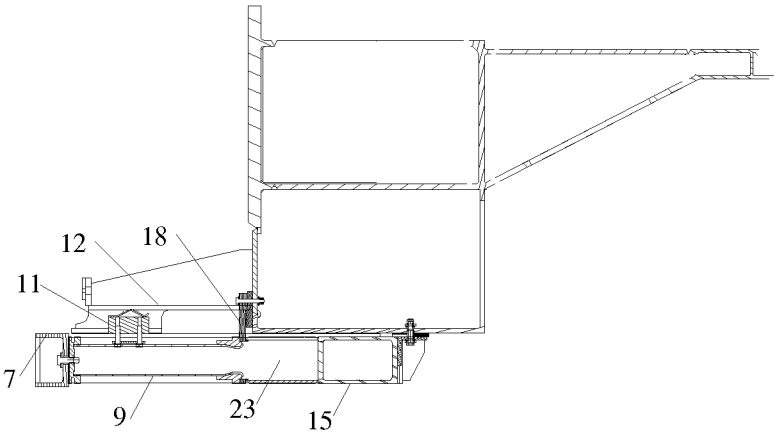
FIG. 4 is an A-A sectional view of FIG. 3.
Figure 5:
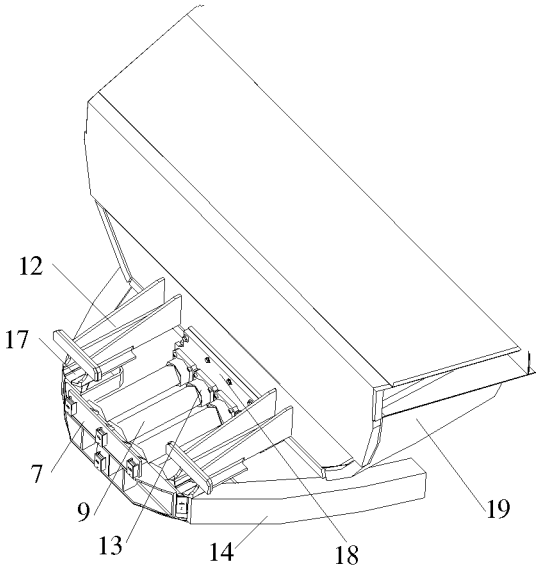
FIG. 5 is a perspective view of FIG. 3.
Figure 6:
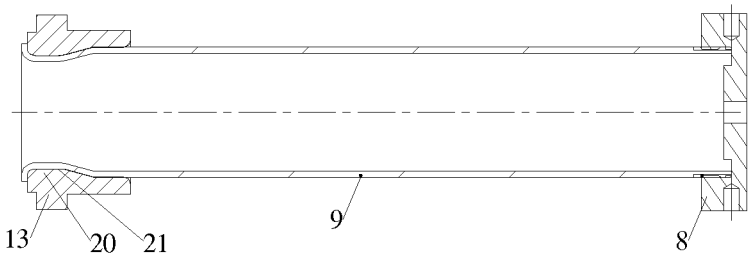
FIG. 6 is a schematic structural diagram, in full section of an energy absorbing tube assembly.

FIG. 3 is a schematic structural diagram of an obstacle removing and energy absorbing device according to an embodiment of the present invention; FIG. 4 is an A-A sectional view of FIG. 3; FIG. 5 is a perspective view of FIG. 3; FIG. 6 is a schematic structural diagram, in full section of the energy absorbing tube 9 assembly; as shown in FIG. 3, FIG. 4, FIG. 5 and FIG. 6, the obstacle removing and energy absorbing device according to an embodiment of the present invention includes an obstacle removing beam 6 and a bumper cross-beam 15 which are oppositely arranged, an energy absorbing tube assembly with an energy absorbing tube 9 is fixedly connected between the obstacle removing beam 6 and the bumper cross-beam 15, a mounting base 8 is fixedly connected with one end of the energy absorbing tube 9, while a crushing support 13 is threaded onto the other end of the energy absorbing tube 9, the crushing support 13 is provided with a variable-diameter through-hole, a crushing convex portion 20 is provided in the variable-diameter through-hole, a concave portion 21 matched with the crushing convex portion 20 is arranged at an end portion where the energy absorbing tube 9 is penetrated into the crushing support 13, the mounting base 8 is fixedly connected with the obstacle removing beam 6, and the crushing support 13 is fixedly connected with the bumper cross-beam 15.

In the above solution, since an energy absorbing tube assembly is provided, when the obstacle removing and energy absorbing device collides with an obstacle and produces large impact, the energy absorbing tube 9 in the energy absorbing tube assembly is crushingly deformed to absorb most of the impact energy, such that the car body suffers less impact, which guarantees stability and safety of the moving train.

The obstacle removing and energy absorbing device according to an embodiment of the present invention includes an obstacle removing beam 6 and a bumper cross-beam 15 which are oppositely arranged, where the obstacle removing beam 6 is provided with an obstacle removing straight beam 7, both ends of the obstacle removing straight beam 7 are weldedly connected with an obstacle removing cambered beam respectively, two obstacle removing cambered beams are symmetrically arranged with respect to the obstacle removing straight beam 7. An end of each obstacle removing cambered beam distal to the obstacle removing straight beam 7 is fixedly connected with a shaft seat 16 via a bolt, and the shaft seat 16 is connected with the bumper cross-beam 15 via a pin bolt, which acts as a rotating shaft of the shaft seat 16, by means of which the shaft seat 16 can rotate with respect to the bumper cross-beam 15. An energy absorbing tube assembly is fixedly connected between the obstacle removing beam 6 and the bumper cross-beam 15, the energy absorbing tube assembly includes an energy absorbing tube 9, which extends in forward-backward direction. A mounting base 8 is fixedly connected with an end of the energy absorbing tube 9 by means of threaded connection, while a crushing support 13 is threaded onto the other end of the energy absorbing tube 9, where the crushing support 13 is provided with a variable-diameter through-hole, a crushing convex portion 20 is provided in the variable-diameter through-hole, an end of the energy absorbing tube 9, which is penetrated into the crushing support 13, is provided with a concave portion 21 matching the crushing convex portion 20, the mounting base 8 is fixedly connected with the obstacle removing beam 6 via a bolt, the crushing support 13 is fixedly connected with the bumper cross-beam 15 via a bolt.

Furthermore, on the basis of the above embodiment, in order to achieve a maximum energy absorbing effect of the energy absorbing tube 9 when being crushingly deformed along forward-backward direction, the obstacle removing and energy absorbing device is further provided with an energy absorbing tube crushing-deformation guiding device, the energy absorbing tube crushing-deformation guiding device is provided with a sliding block 11 and a guide rail 12. Where a sliding block mounting seat 10 is respectively welded on an end of each obstacle removing cambered beam of the obstacle removing beam 6 proximal to the obstacle removing straight beam 7, a sliding block 11 is fixedly connected with the sliding block mounting seat 10 via a bolt, so as to achieve a fixed connection of the sliding block 11 and the obstacle removing beam 6, the sliding block 11 can be a T-shaped sliding block, a swallow-tail-shaped sliding block, of which the former is adopted in this embodiment, a T-shaped sliding groove 17 is provided in the guide rail 12, the sliding groove 17 matches the T-shaped sliding block to achieve guiding, and the guiding direction of the guide rail 12 is consistent with the axial direction of the energy absorbing tube 9, that is, the guiding direction is a forward-backward direction. When used, the guide rail 12 can be fixed on the car body of a locomotive by means of welding.

Figure 7:
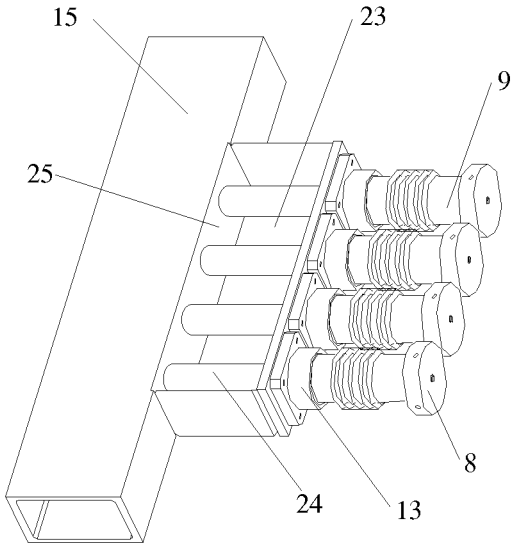
FIG. 7 is a schematic structural diagram of the energy absorbing tube in the obstacle removing and energy absorbing device according to an embodiment of the present invention after absorbing energy and deforming in a first stage.
Figure 8:
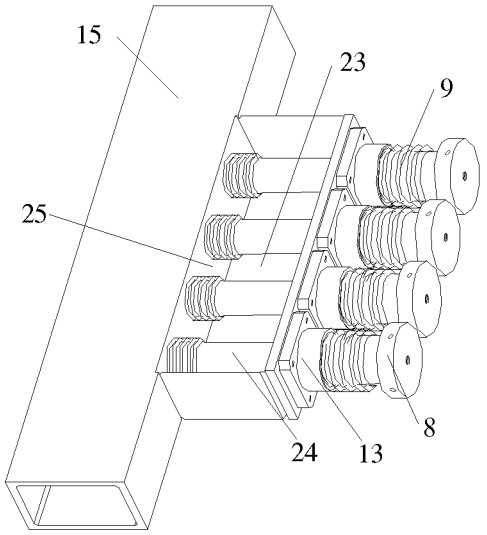
FIG. 8 is a schematic structural diagram of the energy absorbing tube in the obstacle removing and energy absorbing device according to an embodiment of the present invention after absorbing energy and deforming in a second stage.

Furthermore, on the basis of the above embodiment, in order to achieve small and gentle impact on the car body 19 at a starting phase of collision, the obstacle removing and energy absorbing device can adopt a two-level crushing energy absorbing manner, that is, during primary crushing energy absorbing, which is also called energy absorbing deformation in a first stage, the energy absorbing tube 9 being plastically deformed by the crushing convex portion 20 in the variable-diameter through-hole under guiding of the energy absorbing tube crushing-deformation guiding device, such that the tube diameter of the energy absorbing tube reduces and moves backward, meanwhile, the energy absorbing tube 9 absorbs energy through elastic-plastic deformation and heat generation of friction in the diameter reducing deformation. In order to achieve the above two-level crushing energy absorbing manner, the bumper cross-beam 15 is provided with an energy absorbing tube secondary energy absorbing cavity 23, a through-hole for penetrating the energy absorbing tube 9 is provided on a cavity wall of the energy absorbing tube secondary energy absorbing cavity 23 proximal to the energy absorbing tube 9, a tube section 24, diameter of which reduces after being crushed by the crushing convex portion of the crushing support 13, of the energy absorbing tube 9 penetrates through the through-hole into the energy absorbing tube secondary energy absorbing cavity 23, as shown in FIG. 7. An energy absorbing tube secondary deformation acting surface 25 facing the energy absorbing tube 9 is provided on a cavity wall of the energy absorbing tube secondary energy absorbing cavity distal to energy absorbing tube 9. When the diameter reduced tube section 24 of the energy absorbing tube contacts the energy absorbing tube secondary deformation acting surface 25, the energy absorbing tube secondary deformation acting surface 25 stops the diameter reduced tube section 24 of the energy absorbing tube 9 from moving backward, then, at this time, that is, an energy absorbing deformation in a second stage, the diameter reduced tube section 24 of the energy absorbing tube 9 and tube section of original diameter are crushed simultaneously, as shown in FIG. 8, to achieve a plastic bending deformation, and absorb collision energy via the plastic bending deformation, in the secondary crushing energy absorbing stage, compressing force resisted by the energy absorbing tube 9 increases and energy absorbing efficiency improves.

Furthermore, on the basis of the above embodiment, a mounting plate 18 is provided on a front end of the bumper cross-beam 15, the mounting plate 18 is provided with a mounting through-hole, of which an axial direction is the same with the axial direction of the energy absorbing tube 9, the obstacle removing and energy absorbing device is detachably connected with the lower portion of the front end of the car body 19 of the locomotive via a bolt penetrated in the mounting through-hole.

Furthermore, on the basis of the above embodiment, the above energy absorbing tube 9 is a circular tube, the circular tube has a higher average crushing force, more energy absorbed and a simpler structure, when under action of axial impact and quasi static load, an axial symmetrical bending compression crushing mode of the circular tube can absorb and consume the collision maximally, which is beneficial in improving stability and safety of the moving train.

Furthermore, on the basis of the above embodiment, in order to let the energy absorbing tube 9 deform easier by way of regular circular buckling under action of axial compression force, the energy absorbing tube 9 is filled with foamed aluminum (the foamed aluminum is an artificial porous material composed of metal framework and pores (bubble pore formed by a metal framework structure or a planar staggered structure), which possesses properties such as light weight, high strength, good energy absorbing performance etc.), such that it acts certain supporting effect in the energy absorbing tube 9, which shortens the buckling waveform of the energy absorbing tube 9, so that the energy absorbing tube 9 has more folds per unit length, thus significantly improves irregular deformation when being crushed and improves energy absorbing effect.

The present invention further provides a leading car of a motor train unit including a car body, and any obstacle removing and energy absorbing device described above, the bumper cross-beam 15 of the obstacle removing and energy absorbing device is fixedly connected with the lower portion of the front end of the car body 19, and the obstacle removing beam 6 of the obstacle removing and energy absorbing device is arranged towards the moving direction of the leading car. For detailed structure and effect of the obstacle removing and energy absorbing device, please refer to the above embodiments, which will not be described further here.

In addition, when the obstacle removing and energy absorbing device is provided with an energy absorbing tube crushing-deformation guiding device, a guide rail 12 of the energy absorbing tube crushing-deformation guiding device is fixedly connected with the car body 19 by means of welding.

Finally, it should be noted that the above embodiments are merely provided for describing the technical solutions of the present invention, but not intended to limit the present invention. It should be understood by persons skilled in the art that although the present invention has been described in detail with reference to the foregoing embodiments, modifications can be made to the technical solutions described in the foregoing embodiments, or equivalent replacements can be made to some of or all of the technical features in the technical solutions, as long as such modifications or replacements do not cause the essence of corresponding technical solutions to depart from the scope of the embodiments of the present invention.

The invention claimed is:

1. An obstacle removing and energy absorbing device, characterized by comprising an obstacle removing beam and a bumper cross-beam which are oppositely arranged, an energy absorbing tube assembly with an energy absorbing tube is fixedly connected between the obstacle removing beam and the bumper cross-beam, a mounting base is fixedly connected with one end of the energy absorbing tube, while a crushing support is threaded onto the other end of the energy absorbing tube, the crushing support is provided with a variable-diameter through-hole, a crushing convex portion is provided in the variable-diameter through-hole, a concave portion matched with the crushing convex portion is arranged at an end portion where the energy absorbing tube is penetrated into the crushing support, the mounting base is fixedly connected with the obstacle removing beam, and the crushing support is fixedly connected with the bumper cross-beam.

2. The obstacle removing and energy absorbing device according to claim 1, wherein, the obstacle removing device is further provided with an energy absorbing tube crushing-deformation guiding device, the energy absorbing tube crushing-deformation guiding device is provided with a sliding block and a guide rail which are in sliding fit with each other, the sliding block is fixedly connected with the obstacle removing beam, a guiding direction of the guide rail is in consistent with an axial direction of the energy absorbing tube.

3. The obstacle removing and energy absorbing device according to claim 1, wherein, the bumper cross-beam is provided with an energy absorbing tube secondary energy absorbing cavity, a through-hole for penetrating the energy absorbing tube is provided on a cavity wall of the energy absorbing tube secondary energy absorbing cavity proximal to the energy absorbing tube, and an energy absorbing tube secondary deformation acting surface facing the energy absorbing tube is provided on a cavity wall of the energy absorbing tube secondary energy absorbing cavity distal to the energy absorbing tube.

4. The obstacle removing and energy absorbing device according to claim 1, wherein, the bumper cross-beam is further provided with a mounting plate, the mounting plate is provided with a mounting through-hole, an axial direction of which is the same with the axial direction of the energy absorbing tube.

5. The obstacle removing and energy absorbing device according to claim 1, wherein, the energy absorbing tube is a circular tube.

6. The obstacle removing and energy absorbing device according to claim 1, wherein, the energy absorbing tube is filled with foamed aluminum.

7. The obstacle removing and energy absorbing device according to claim 1, wherein, both ends of the obstacle removing beam are fixedly connected with a shaft seat, the shaft seat is rotatablely connected with the bumper cross-beam.

8. The obstacle removing and energy absorbing device according to claim 7, wherein, the obstacle removing beam is provided with an obstacle removing straight beam, both ends of the obstacle removing straight beam are fixedly connected with an obstacle removing cambered beam, and the shaft seat is fixedly connected with the obstacle removing cambered beam.

9. A leading car of a motor train unit, comprising a car body, and the obstacle removing and energy absorbing device according to claim 1, wherein the bumper cross-beam of the obstacle removing and energy absorbing device is fixedly connected with a lower portion of a front end of the car body, and the obstacle removing beam of the obstacle removing and energy absorbing device is arranged towards the moving direction of the leading car.

10. A leading car of a motor train unit, comprising a car body, and the obstacle removing and energy absorbing device according to claim 2, wherein the bumper cross-beam of the obstacle removing and energy absorbing device is fixedly connected with a lower portion of a front end of the car body, and the obstacle removing beam of the obstacle removing and energy absorbing device is arranged towards the moving direction of the leading car.

11. A leading car of a motor train unit, comprising a car body, and the obstacle removing and energy absorbing device according to claim 3, wherein the bumper cross-beam of the obstacle removing and energy absorbing device is fixedly connected with a lower portion of a front end of the car body, and the obstacle removing beam of the obstacle removing and energy absorbing device is arranged towards the moving direction of the leading car.

12. A leading car of a motor train unit, comprising a car body, and the obstacle removing and energy absorbing device according to claim 4, wherein the bumper cross-beam of the obstacle removing and energy absorbing device is fixedly connected with a lower portion of a front end of the car body, and the obstacle removing beam of the obstacle removing and energy absorbing device is arranged towards the moving direction of the leading car.

13. A leading car of a motor train unit, comprising a car body, and the obstacle removing and energy absorbing device according to claim 5, wherein the bumper cross-beam of the obstacle removing and energy absorbing device is fixedly connected with a lower portion of a front end of the car body, and the obstacle removing beam of the obstacle removing and energy absorbing device is arranged towards the moving direction of the leading car.

14. A leading car of a motor train unit, comprising a car body, and the obstacle removing and energy absorbing device according to claim 6, wherein the bumper cross-beam of the obstacle removing and energy absorbing device is fixedly connected with a lower portion of a front end of the car body, and the obstacle removing beam of the obstacle removing and energy absorbing device is arranged towards the moving direction of the leading car.

15. A leading car of a motor train unit, comprising a car body, and the obstacle removing and energy absorbing device according to claim 7, wherein the bumper cross-beam of the obstacle removing and energy absorbing device is fixedly connected with a lower portion of a front end of the car body, and the obstacle removing beam of the obstacle removing and energy absorbing device is arranged towards the moving direction of the leading car.

16. A leading car of a motor train unit, comprising a car body, and the obstacle removing and energy absorbing device according to claim 8, wherein the bumper cross-beam of the obstacle removing and energy absorbing device is fixedly connected with a lower portion of a front end of the car body, and the obstacle removing beam of the obstacle removing and energy absorbing device is arranged towards the moving direction of the leading car.

17. The leading car of a motor train unit according to claim 9, wherein, when the obstacle removing and energy absorbing device is provided with an energy absorbing tube crushing-deformation guiding device, and a guide rail of the energy absorbing tube crushing-deformation guiding device is fixedly connected with the car body.

18. The leading car of a motor train unit according to claim 10, wherein, when the obstacle removing and energy absorbing device is provided with an energy absorbing tube crushing-deformation guiding device, and a guide rail of the energy absorbing tube crushing-deformation guiding device is fixedly connected with the car body.

19. The leading car of a motor train unit according to claim 11, wherein, when the obstacle removing and energy absorbing device is provided with an energy absorbing tube crushing-deformation guiding device, and a guide rail of the energy absorbing tube crushing-deformation guiding device is fixedly connected with the car body.

20. The leading car of a motor train unit according to claim 12, wherein, when the obstacle removing and energy absorbing device is provided with an energy absorbing tube crushing-deformation guiding device, and a guide rail of the energy absorbing tube crushing-deformation guiding device is fixedly connected with the car body.

* * * * *